United States Patent [19]

Wang

[11] Patent Number: 4,982,952

[45] Date of Patent: Jan. 8, 1991

[54] SIMULATED CLIMBING EXERCISE DEVICE

[76] Inventor: Shui-Mu Wang, No. 25, Huan-Kung Rd., Yung-Kang Hsiang, Taiwan

[21] Appl. No.: 514,130

[22] Filed: Apr. 25, 1990

[51] Int. Cl.[5] ..... A63B 23/04

[52] U.S. Cl. ..... 272/70; 272/130

[58] Field of Search ..... 272/69, 70, 130, 71, 272/73, 121, 96; 128/25 R

[56] References Cited

U.S. PATENT DOCUMENTS 3,381,958 5/1968 Gulland ..... 272/121

4,838,543 6/1989 Armstrong et al. ..... 272/70

FOREIGN PATENT DOCUMENTS

89/04697 6/1989 World Int. Prop. O. ..... 272/70

*Primary Examiner*—Stephen R. Crow

*Attorney, Agent, or Firm*—Marshall & Melhorn

[57] ABSTRACT

The exercise device includes a base; an elongated prop extending upward from the base and having an upper and a lower longitudinal slide groove; a first left and a first right slide piece movably disposed on opposite sides of the elongated prop in the upper slide groove, each of the first left and right slide pieces having a handle piece; a second left and a second right slide piece movably disposed on opposite sides of the elongated prop at the lower slide groove, each of the second left and right slide pieces having a foot support piece; a left vertical adjoining plate connecting the first and second left slide pieces; a right vertical adjoining plate connecting the first and second right slide pieces; a pulley and a cable passing over the pulley and having two ends, each of the left and right vertical adjoining plates having a top end attached to one end of the cable; and a pair of hydraulic cylinders, each having a piston rod coupled to one of the second left and right slide pieces, the hydraulic cylinders being hinged to the base.

5 Claims, 4 Drawing Sheets

( 3 ~ 3 )

SIMULATED CLIMBING EXERCISE DEVICE

BACKGROUND OF THE INVENTION

This invention relates to an exercise device, more particularly to a simulated climbing exercise device.

The object of this invention is to provide a simulated climbing exercise device which allows the simultaneous exercising of both arms and legs.

SUMMARY OF THE INVENTION

Accordingly, the preferred embodiment of an exercise device of this invention comprises a base; an elongated prop extending upward from the base and having an upper and a lower longitudinal slide groove; a first left and a first right slide piece movably disposed on opposite sides of the elongated prop in the upper slide groove, each of the first left and right slide pieces having a handle piece; a second left and a second right slide piece movably disposed on opposite sides of the elongated prop at the lower slide groove, each of the second left and right slide pieces having a foot support piece; a left vertical adjoining plate connecting the first and second left slide pieces; a right vertical adjoining plate connecting the first and second right slide pieces; means for alternatingly moving the left and the right vertical adjoining plates downward and upward, the alternating movement means being provided adjacent to a top end of the elongated prop and connected to the left and right vertical adjoining plates; and means for providing a resisting force against any movement of the left and right vertical adjoining plates, the resistance means being mounted to the base and connected to the second left and right slide pieces.

BRIEF DESCRIPTION OF THE DRAWINGS

Other features and advantages of this invention will become apparent in the following detailed description of the preferred embodiment with reference to the accompanying drawings, in which.

DETAILED DESCRIPTION OF THE PREFERRED EMBODIMENT

Figure 1:
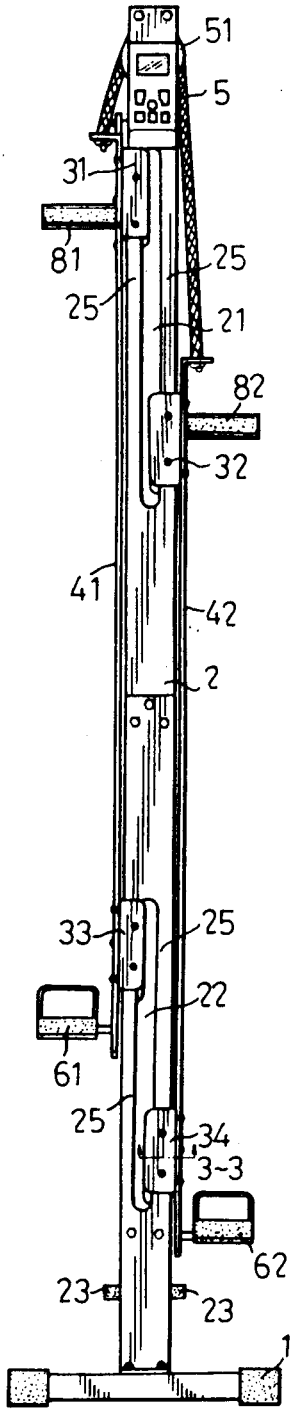
FIGS. 1, 2 are schematic views of the preferred embodiment of an exercise device according to this invention.

Referring to FIG. 1, the preferred embodiment of an exercise device according to this invention is shown to comprise a rectangular base 1 which supports an elongated prop 2 having an upper and a lower longitudinal slide groove 21, 22. A first left and a first right slide piece 31, 32 are oppositely and movably disposed on the elongated prop 2 at the upper slide groove 21. A second left and a second right slice piece 33, 34 are similarly oppositely and movably disposed on the elongated prop 2 at the lower slide groove 22. The first and second left slide pieces, 31 and 33, are connected via a left vertical adjoining plate 41. The first and second right slide pieces 32, 34 are similarly connected via a right vertical adjoining plate 42. The top ends of the left and right vertical adjoining plates, 41 and 42, are connected to two ends of a cable 5 passing over a pulley 51. A downward movement of one of the vertical adjoining plates 41, 42 will thus cause the other adjoining plate to move up.

Figure 2:
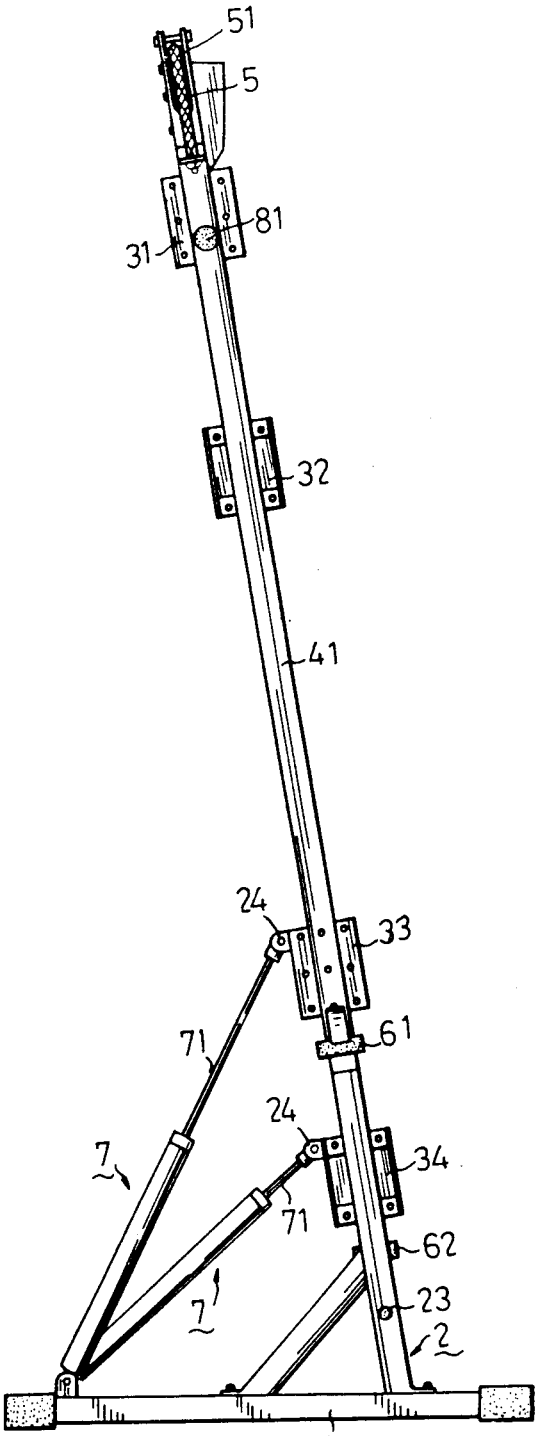

A side view of the preferred embodiment is shown in FIG. 2. A left and a right foot support, 61 and 62, are respectively attached to a lower portion of the left and right vertical adjoining plates, 41 and 42. A stopper 23 is disposed on each side of the elongated prop 2 below the left and right vertical adjoining plates, 41 and 42. Each of the second slide pieces, 33 and 34, has a rear coupling projection 24 for connection with one end of a piston rod 71 of a hydraulic cylinder 7. Each hydraulic cylinder 7 has one end hinged to the rectangular base 1. The first slide pieces, 31 and 32 have a left and a right handle, 81 and 82, respectively.

Figure 3:
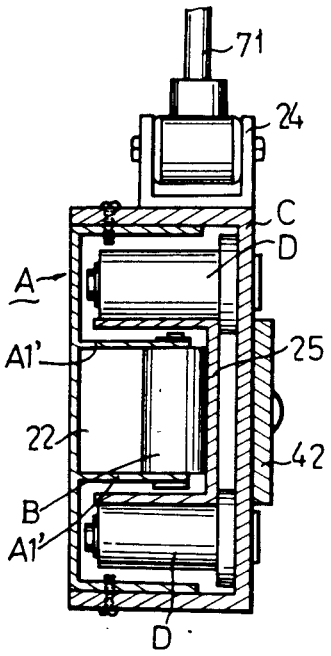
FIG. 3 is a sectional view of the preferred embodiment illustrating assembly.

As shown in FIG. 3, each of the four slide pieces, 31, 32, 33 and 34, comprises a first casing part A, a first roller B, a second casing part C and a pair of second rollers D.

The first and second casing parts, A and C, are substantially U-shaped in cross section and are attached to one another with screws. A pair of partition plates A1′ is parallel to the shorter, transverse sides of the first and second casing parts A, C. The first and second casing parts, A and C, surrounds one of the divided parts 25 of the elongated prop 2 adjacent to the slide grooves 21 or 22. The first casing part A extends in the slide grooves 21 or 22.

The first roller B is rotatably mounted to the partition plates A1′. The rear coupling projection 24 is formed at one side of the second casing part C. The second rollers D are rotatably mounted to the second casing part C on two sides of the first roller B. The second rollers D have an axis of rotation transverse to that of the first roller B. The first and second rollers, B and D, are in rolling contact with the channel-like division, part 25, of the elongated prop 2.

Figure 4:
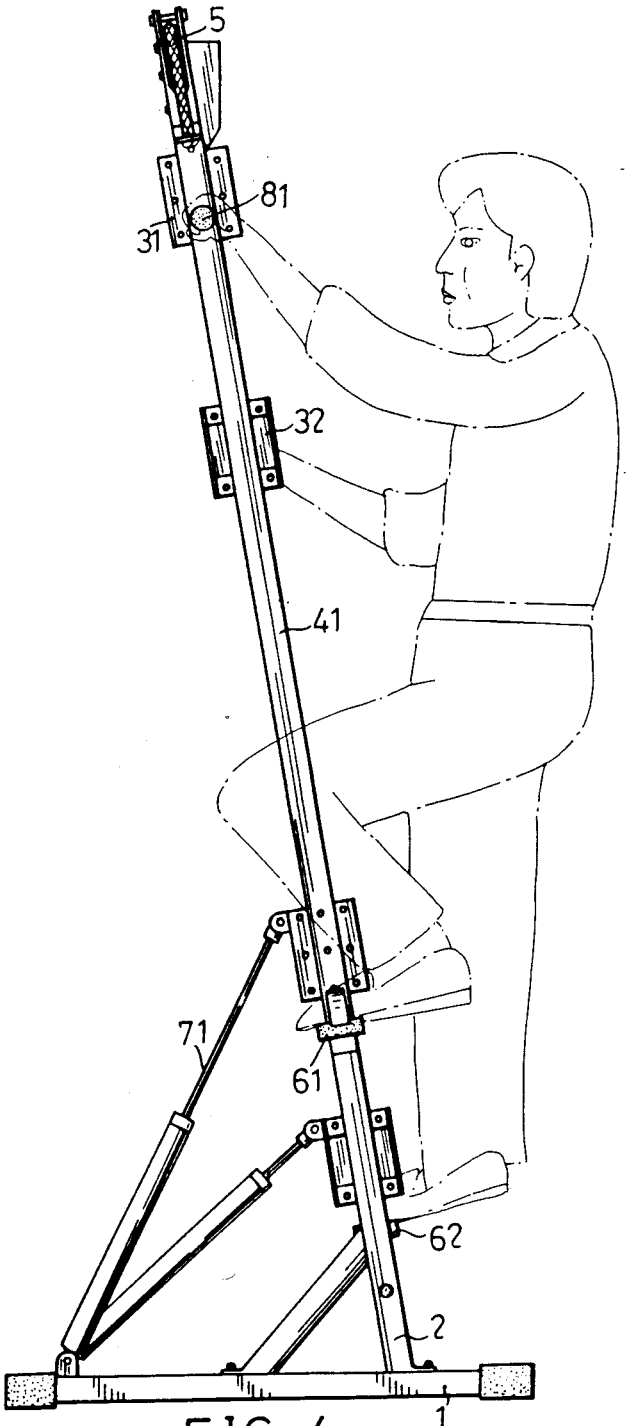
FIG. 4 is a schematic view of the preferred embodiment illustrating proper usage.

FIG. 4 is an illustration of the preferred embodiment when in use. The user's feet rest on the left and right foot supports, 61 and 62, while the user's hands grasp the left and right handles, 81 and 82. The stoppers 23 control the maximum displacement of the left and right vertical adjoining plates, 41 and 42, on the elongated prop 2 by preventing any further downward movement of the vertical adjoining plates, 41 and 42. The stoppers 23 thus prevent the first and second slide pieces, 31, 32, 33 and 34, from impacting the lowest portion of the upper and lower slide grooves 21, 22 confined by the elongated prop 2. The first and second rollers, B and D, allow movement of the first and second slide pieces, 31, 32, 33 and 34, on the elongated prop 2 and provide reduced kinetic friction between the first and second slide pieces, 31, 32, 33 and 34, and the elongated prop 2. The rectangular base 1 supports the elongated prop 2 in such a manner that the elongated prop 2 inclines with respect to a vertical axis. This is to enable the user to easily and properly position himself on the preferred embodiment, thus making the use convenient.

When exercising the arms, the user pulls one of the handles, 81 or 82, to move one of the vertical adjoining plates 41, 42 downwards and the other vertical adjoining plate upwards. The movement of the vertical adjoining plates, 41 and 42, correspondingly push or pull the piston rods 71 against the hydraulic cylinders 7. The hydraulic cylinders 7 provide a force that resists the movement of the vertical adjoining plates, 41 and 42, to enable the preferred embodiment to serve as a training means for muscular development of the arms.

When exercising the legs, the user exerts a downward pushing force on one of the foot supports, 61 or 62, to similarly move one of the vertical adjoining plates, 41 or 42, downwards and thus overcome the resistance provided by the hydraulic cylinders 7. The means for overcoming the resistance provided by the hydraulic cylinders 7 is not restricted to the pulling of one of the handles, 81 or 82, or to the pushing of one of the foot supports, 61 or 62. The user may employ a combination of the two means, depending upon the desired development of physique, to overcome the resistance of the hydraulic cylinders 7.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. An exercise device, comprising:

a base;

an elongated prop extending upward from said base and having an upper and a lower longitudinal slide groove;

a first left and a first right slide piece movably disposed on opposite sides of said elongated prop in said upper slide groove, each of said first left and said first right slide pieces having a handle piece;

a second left and a second right slide piece movably disposed on opposite sides of said elongated prop at said lower slide groove, each of said second left and second right slide pieces having a foot support piece;

a left vertical adjoining plate connecting said first and said second left slide pieces;

a right vertical adjoining plate connecting said first and said second right slide pieces;

means for alternatingly moving said left and said right vertical adjoining plates downward and upward, said alternating movement means being provided adjacent to a top end of said elongated prop and connected to said left and said right vertical adjoining plates; and hydraulic cylinder resistance means for providing a resisting force against any movement of said left and said right vertical adjoining plates, said hydraulic cylinder resistance means being mounted to said base and connected to said second left and said second right slide pieces.

2. An exercise device as claimed in claim 1, wherein said alternating movement means comprises a pulley and a cable passing over said pulley and having two ends, each of said left and said right vertical adjoining plates having a top end attached to one end of said cable.

3. An exercise device as claimed in claim 1, wherein said hydraulic cylinder resistance means comprises a pair of hydraulic cylinders, each having a piston rod coupled to one of said second left and said second right slide pieces, said hydraulic cylinders being hinged to said base.

4. An exercise device as claimed in claim 1, further comprising a stopper disposed on opposite sides of said elongated prop beneath said left and said right vertical adjoining plates for controlling the maximum displacement of said vertical adjoining plates by preventing any further downward movement of the same.

5. An exercise device as claimed in claim 1, wherein said elongated prop has two divided parts on two sides of each of said upper and said lower slide grooves; each of said slide pieces comprising a casing which surrounds one of said divided parts, and rollers mounted to said casing and placed in rolling contact with said one divided part.

* * * * *